United States Patent [19]

Essig

[11] Patent Number: 4,809,635

[45] Date of Patent: Mar. 7, 1989

[54] MOORING LINE RETRIEVING DEVICE

[76] Inventor: Nels J. Essig, 2864 Park Dr., Milford, Mich. 48042

[21] Appl. No.: 34,689

[22] Filed: Apr. 6, 1987

[51] Int. Cl.[4] ..... B63B 21/00

[52] U.S. Cl. ..... 114/230; 114/242

[58] Field of Search ..... 119/151-153; 114/230, 242, 381, 251, 253, 254; 248/277

[56] References Cited

U.S. PATENT DOCUMENTS

| | | | |
|---|---|---|---|
| 2,118,337 | 5/1938 | Blanchard | 248/277 |
| 3,012,736 | 12/1961 | Brust | 242/107.5 |
| 3,151,595 | 10/1964 | Stainbrook | 114/330 |
| 3,224,404 | 12/1965 | De Jong | 119/153 |
| 3,278,247 | 10/1966 | Tispell | 248/277 |
| 3,402,959 | 9/1968 | Harris | 119/153 |
| 4,022,450 | 5/1977 | Smith, Jr. | 267/73 |
| 4,200,052 | 4/1980 | Cunningham et al. | 114/230 |
| 4,280,440 | 7/1981 | Barten | 114/230 |
| 4,462,329 | 7/1984 | Brushaber | 114/230 |
| 4,476,801 | 10/1984 | Foster et al. | 114/230 |
| 4,479,454 | 10/1984 | Schepel | 114/230 |
| 4,529,388 | 7/1985 | Jones | 114/230 |
| 4,543,903 | 10/1985 | Kramer | 114/230 |
| 4,627,375 | 12/1986 | Davis | 114/230 |
| 4,656,961 | 4/1987 | Hellkamp | 114/230 |
| 4,676,182 | 6/1987 | Chaiko | 114/230 |
| 4,697,537 | 10/1987 | Smith | 114/230 |

*Primary Examiner*—Joseph F. Peters, Jr.
*Assistant Examiner*—Clifford T. Bartz
*Attorney, Agent, or Firm*—Gifford, Groh, Sheridan, Sprinkle and Dolgorukov

[57] ABSTRACT

A device for retaining, carrying and making easily graspable one end of a mooring line for a boat adjacent a dock or mooring. The device includes an extensible member having two ends and which is movable between an extended position in which the ends are spaced apart from each other and a retracted position in which the ends are closely adjacent each other. One end of the extensible member is secured to a predetermined position adjacent the dock or mooring buoy while the other end of the extensible member is fashioned into an easily grasped shape and is detachably secured adjacent to a free end of the mooring line. A spring or other means is used to urge the extensible member towards its retracted position so that the device maintains the mooring line at a predetermined accessible position adjacent the dock or mooring and above the water line. This enables the mooring line to be easily retrieved by the returning boater and used in its normal fashion to secure the boat.

8 Claims, 1 Drawing Sheet

MOORING LINE RETRIEVING DEVICE

BACKGROUND OF THE INVENTION

I. Field of the Invention

The present invention relates generally to marine devices and, more particularly, to a device for retaining, carrying and making easily graspable a mooring line in an accessible position adjacent a dock, or mooring.

II. Description of the Prior Art

In conventional docking facilities found in marinas and the like, the dock includes a plurality of piers which extend outwardly at spaced intervals and form a slip. A boat in the slip is then secured to the dock by one or more mooring lines. A conventional moorage includes a plurality of buoys anchored to the sea bottom so as to hold the buoy in position. A boat is then secured to the buoy with one or more mooring lines.

During the operation of securing the boat within the slip, or to the mooring, the boat enters the same while o the boater on the boat utilizes a boat hook to engage either the mooring line on the dock or ring on the buoy. Once engaged, the boater brings a free end of the mooring line from the dock onto the boat and secures the mooring line to the boat within the slip in the normal fashion or, in the case of a buoy, ties the mooring line onto the buoy ring. The other end of the mooring line is tied to the dock, or buoy.

In many cases, however, the free end of the mooring line is hanging down into the water as the boater enters the slip. This makes it not only difficult for the boater to engage the free end of the mooring line with the boat hook, but also extends the amount of time required to secure the boat safely within its slip or to its buoy thereby increasing the likelihood of sustaining damage to the boat, other boats and/or the docking structure.

There have been a number of previously known devices which are designed to maintain the mooring lines in an accessible position at the dock slip. These previously known devices typically comprise brackets of one sort or another which are intended to hold the free end of the mooring line out of the water and thus accessible to the boater.

These previously known devices, however, have not proven wholly satisfactory in operation. A primary disadvantage of these previously known brackets is that the free end of the mooring line frequently cannot be secured to the bracket quickly enough prior to departure or it falls from the bracket and into the water thus resulting in the same problems as occur without the bracket at all. Furthermore, many of these previously known brackets extend outwardly into the dock slip and thus interfere with the normal docking action for the boat. Further yet many mooring lines are attached to a dock many feet farther away than will allow reaching all remaining lines once one or more have been secured.

SUMMARY OF THE PRESENT INVENTION

The present invention provides an easily graspable mooring line retaining and carrying device which overcomes all the above mentioned disadvantages of the previously known devices.

In brief, the mooring line retaining device of the present invention comprises an elongated extensible member having two ends. The extensible member is movable between a retracted position, in which its ends are adjacent each other, and an extended position, in which its ends are spaced apart from each other. In addition, means, such as a spring, urge the extensible member towards its retracted position.

One end of the extensible member is secured to a preselected position adjacent the dock while the other end of the extensible member is fashioned into an easily graspable shape, such as a loop, and is detachably secured to the free end of the mooring line. Alternately, an easily graspable member is secured to the free end of the mooring line. The extensible member itself is positioned so that it remains above the water line.

In practice, the graspable member on the extensible member in its retracted position holds the free end of the mooring line in an accessible position adjacent the dock and above the water line so that the graspable member can be easily engaged by the boater with a boat hook. Once engaged, the graspable member is pulled onto the boat and, in doing so, moves the extensible member to its extended position, carrying along with it the free end of the mooring line. With the mooring line on the boat, the mooring line is removed from the graspable member and then used in its normal fashion to secure the boat within the slip. The graspable member itself is either simply released where upon the spring returns it to its retracted position or it is guided back to its retracted position by the boat hook 51.

Conversely, when leaving the moorage, the mooring line is first removed from the boat and attached to the graspable member of the extensible member. The line and graspable member are then released and the spring returns the extensible member to its retracted position, or it is guided to its retracted position by the boat hook, thus returning the free end of the mooring line to its accessible position adjacent the dock and above the water line.

There are many different configurations which can be used for the extensible member. In one preferred embodiment of the invention, the extensible member comprises an elongated cord which is wound around a reel rotatably mounted within a housing. The housing in turn is secured to the dock. In addition, a spring is coupled with the reel and thus urges the reel in one rotatable direction thereby urging the cord into a wound condition around the reel.

Other types of extensible members can also be used while remaining within the scope and intent of the present invention.

BRIEF DESCRIPTION OF THE DRAWING

A better understanding of the present invention will be had upon reference to the accompanying drawing wherein like reference characters refer to like parts throughout the several views, and in which.

DETAILED DESCRIPTION OF A PREFERRED EMBODIMENT OF THE PRESENT INVENTION

Figure 1:
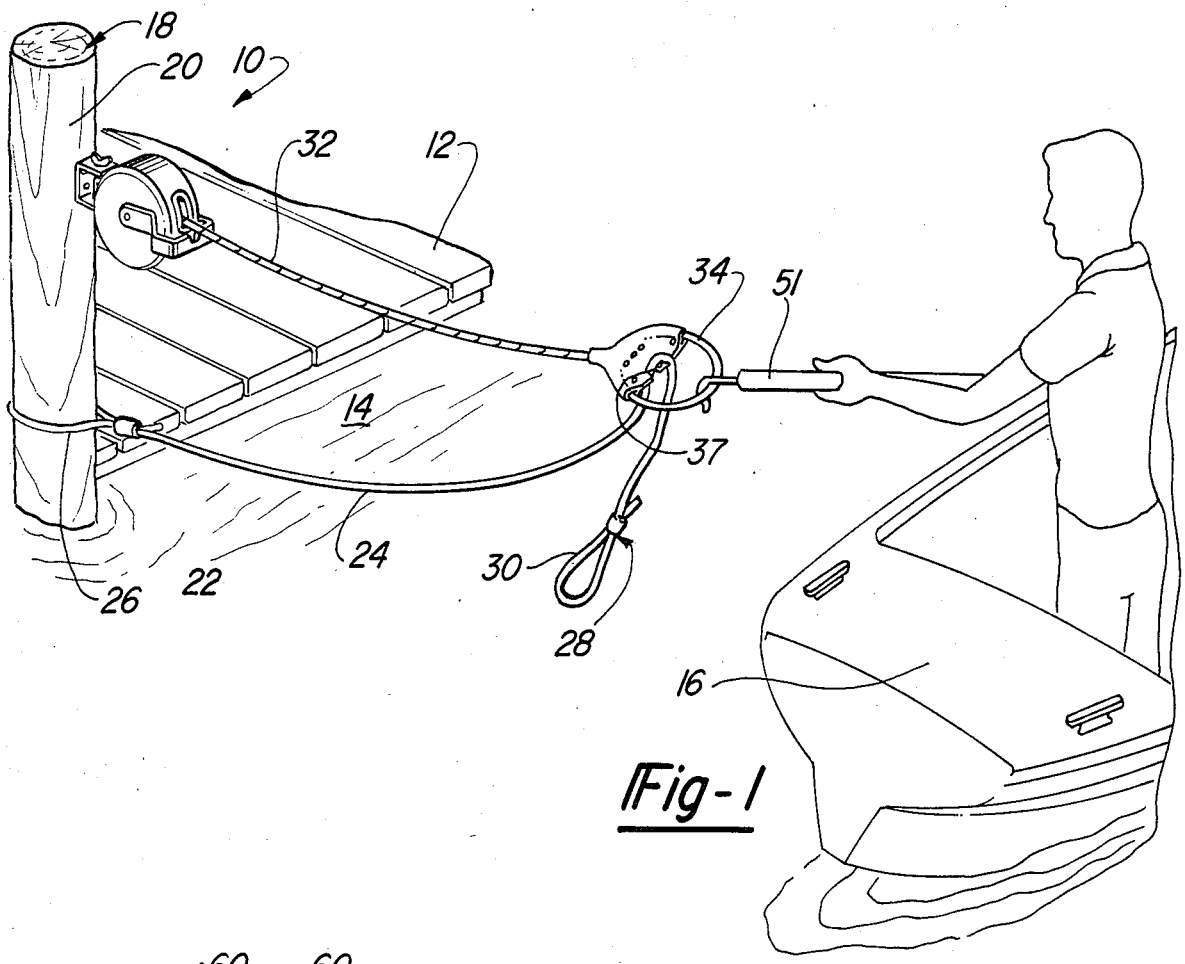
FIG. 1 is a perspective view illustrating a preferred embodiment of the present invention.

With reference first to FIG. 1, a preferred embodiment of the mooring line retaining device 10 of the present invention is thereshown for use with a dock 12 in a marina or the like. The dock 12 can include, for example, a slip 14 into which an aquatic vehicle or boat 16 is positioned. Alternatively, the mooring line is secured to a mooring buoy unattached to a dock. However, in this patent the term "dock" shall collectively refer to docks and mooring buoys.

Still referring to FIG. 1, the dock 12 is thereshown as including a piling 18 having a portion 20 which is positioned above the water line 22 of the water body. In addition, an elongated mooring line 24 has one end 26 secured to the dock 12, such as by being wrapped around the piling 18, while the other end 28 of the mooring line 24 is free. The free end 28 of the mooring line 24, furthermore, sometimes includes a loop 30 which is used to secure the boat 16 within the slip 14.

Figure 2:
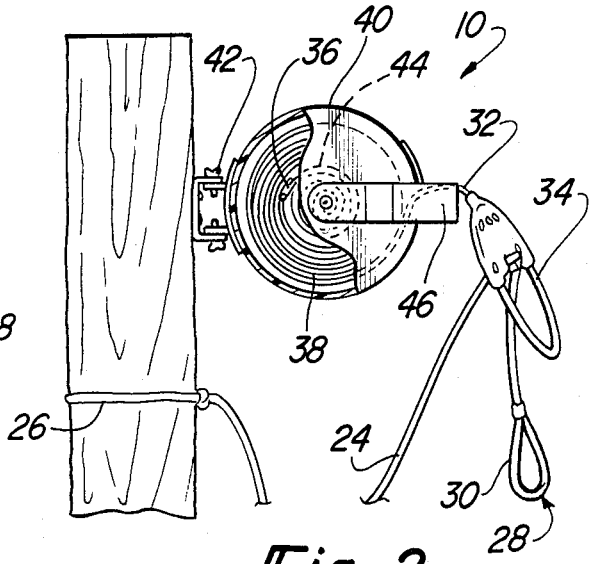
FIG. 2 is a fragmentary sectional side view illustrating a preferred embodiment of the present invention in a retracted position.

Referring now particularly to FIGS. 1 and 2, the mooring line retaining device 10 of the present invention further comprises an elongated extensible member 32 having two ends 34 and 36 (FIG. 2). The extensible member 32, furthermore, is movable between a retracted position, illustrated in FIG. 2, and an extended position, illustrated in FIG. 1. In its retracted position (FIG. 2) the ends 34 and 36 of the extensible member 32 are positioned closely adjacent each other. Conversely, in its extended position (FIG. 1) the ends 34 and 36 of the extensible member 32 are spaced apart from each other.

An easily graspable member 34, such as a loop, is either secured to or formed as a part of the free end 33 of the extensible member 32.

In the embodiment of the invention illustrated in FIGS. 1 and 2, the extensible member 32 comprises an elongated flexible cord which is wound about a reel 38 (FIG. 2). The reel 38 is rotatably mounted within a housing 40 and this housing 40 is, in turn, secured by any conventional means 42 to a preselected position adjacent the dock 12 and above the water line 22.

Referring now particularly to FIG. 2, the device 10 further includes means, such as a spring 44 (illustrated only diagrammatically) for urging the reel 38 in one rotational direction and thus urging the cord or extensible member 32 towards a retracted position. When the cord or extensible member 32 is moved to its extended position, the reel 38 is unwound but, upon release of the cord 32, the cord 32 will return to its retracted position (FIG. 2).

Still referring still to FIGS. 1 and 2, the other or free end 33 of the cord is detachably secured in any conventional fashion to the free end 28 of the mooring line 24. Any conventional means 37, such as a jammed frictional fit or cleat, between the member 34 and the mooring line end 28 can be used to detachably secure the mooring line end 28 and member 34 together. Thus, with the mooring line 24 disconnected from the boat 16, the device 10 maintains the free end 28 of the mooring line 24, and thus the mooring line loop 30 (if so equipped), at a predetermined position with respect to the dock 12 above the water line.

Consequently, the device 10 maintains the mooring line, when secured to the graspable member 34, in an accessible and easily graspable position adjacent the dock so that it can be easily retrieved by a boat hook 51. Once engaged, the graspable member 34 carries the mooring line 24 to the extended position as shown in FIG. 1 thus moving the extensible member 32 to an extended position. This allows the mooring line 24 to be detached from the graspable member 34 and used in its normal fashion to secure the boat 16 within the slip. The graspable member 34 is also released and the spring 44 returns the extensible member to its retracted position (FIG. 1) utilizing the boat hook as a guide.

Conversely, prior to leaving the dock, the graspable member 34 is engaged by the boat hook 51 and moved to its extended position. The mooring line 24 is then detached from the boat, its free end 33 attached to the graspable member 34 and the graspable member is released. In doing so, the spring 44 returns the extensible member 32 with the attached mooring line 28 to its retracted position (FIG. 2), possibly using the boat hook as a guide, thereby retaining the mooring line 24 and graspable member 34 in an accessible position above the waterline for subsequent uses.

As best shown in FIG. 2, the retaining device 10 preferably includes a bracket 46 or other means to engage and support the graspable member 34 of the extensible member 32, with its attached mooring line 24 when the extensible member 32 is in its retracted position.

Figure 3:
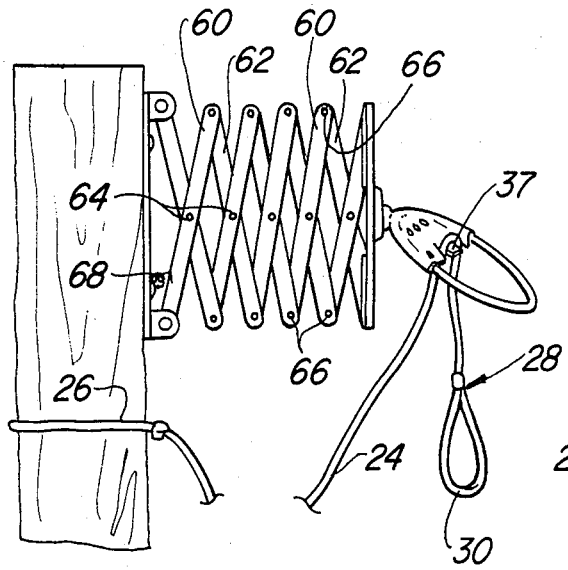
FIG. 3 is a view similar to FIG. 2 but showing a modification thereof.

It will be understood, of course, that other types of extensible members other than the elongated cord illustrated in FIGS. 1 and 2 can be used without deviation from either the spirit or scope of the present invention. For example, as shown in FIG. 3, an alternate embodiment of the present invention is thereshown in which a plurality of criss-crossing bars 60 and 62 form the extensible member 32 in lieu of the cord shown in FIG. 1 and 2. These criss-crossing bars 60 and 62 are each pivotally mounted together at their centers 64 and are pivotally secured at their ends 66 to adjacent bars. A spring 68 (illustrated only diagrammatically) is used to urge the criss-crossing bars 60 and 62 to the retracted position illustrated in FIG. 3.

As before, the mooring line 24 has one end 26 secured to the dock or piling 18 while the other end 28 of the mooring line 24 is secured to an outer or free end of the criss-crossing bars 60 and 62 which is fashioned into a graspable member 35. The other end of the criss-crossing bars 60 and 62 are secured to the dock 12.

As before, the spring 68 urges the criss-crossing members 60 and 62 to a retracted position which maintains the free end 28 of the mooring line 24 attached to the graspable member and in an accessible position adjacent the dock 12. The criss-crossing members 60 and 62, however, are movable to an extended position thereby allowing the mooring line 28 to be used in its normal fashion.

Although only two embodiments of the present invention have been described, it will be understood that further modifications thereto can be used without deviation from either the scope or spirit of the present invention as defined in the appended claims.

I claim:

1. A device for retaining, carrying and making easily graspable one end of a mooring line for an aquatic vehicle in an accessible position adjacent a dock comprising an extensible member having two ends, said extensible member being movable between an extended position and a retracted position, wherein in said extended position said ends of said extensible member are spaced apart from each other by a distance greater than when said extensible member is in said retracted position, and also so that in said extended position, one end of said extensible member is in said accessible position to the aquatic vehicle, a graspable member secured to one end of said extensible member, means for urging said extensible member towards said retracted position, said urging means being separate from said extensible member, means for detachably securing said one end of said extensible member to said one end of the mooring line, so that said one end of said mooring line travels in unison with said one end of said extensible member as said extensible member moves between said retracted and said extended position, and means for securing the other end of said extensible member to a predetermined position adjacent the dock.

2. The invention as defined in claim 1 wherein said extensible member comprises an elongated flexible cord.

3. The invention as defined in claim 2 wherein said device further comprises a housing, a reel rotatably mounted in said housing and wherein said cord is wound around said reel.

4. The invention as defined in claim 3 wherein said urging means comprises means for resiliently urging said reel in one rotational direction.

5. The invention as defined in claim 4 wherein said means for securing the other end of the extensible member comprises means for securing said housing to said predetermined position adjacent the dock.

6. The invention as defined in claim 5 and further comprising a bracket secured to said housing, said bracket being positioned to engage and support said mooring line and graspable member when said extensible member is in said retracted position.

7. The invention as defined in claim 1 wherein said extensible member further comprises a plurality of crisscrossing rigid bars, said bars being pivotally secured together at a midpoint and being pivotally secured at each end to an adjacent bar.

8. The invention as defined in claim 1 wherein the outer end of the extensible member is fashioned into said graspable member.

* * * * *